US006942312B2

(12) United States Patent
Leung et al.

(10) Patent No.: US 6,942,312 B2
(45) Date of Patent: Sep. 13, 2005

(54) METHOD AND APPARATUS RELATED TO INFORMATIVE DATA ASSOCIATED WITH GRAPHICAL IMAGE DATA

(75) Inventors: Sui-hing Leung, Cupertino, CA (US); Xiao-An Zhang, Sunnyvale, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 50 days.

(21) Appl. No.: 10/621,223

(22) Filed: Jul. 16, 2003

(65) Prior Publication Data

US 2005/0012771 A1 Jan. 20, 2005

(51) Int. Cl.[7] ..... B41J 29/393; B41J 23/00

(52) U.S. Cl. ..... 347/19; 347/37

(58) Field of Search ..... 347/2–3, 14, 19, 347/37, 116; 346/23; 358/1.9, 906; 396/312, 320; 348/207.2; 360/76, 77.01, 77.12, 77.17

(56) References Cited

U.S. PATENT DOCUMENTS 3,678,220 A * 7/1972 Luhrs ..... 360/71
5,521,663 A * 5/1996 Norris, III ..... 396/312
5,757,468 A * 5/1998 Patton et al. ..... 355/40
5,917,671 A * 6/1999 Kaaden et al. ..... 360/77.12
6,036,298 A 3/2000 Walker
6,430,008 B1 * 8/2002 Trabert et al. ..... 360/317
6,647,369 B1 * 11/2003 Silverbrook et al. ..... 704/273
2002/0141750 A1 10/2002 Ludtke et al.

FOREIGN PATENT DOCUMENTS

EP 0913989A 2 5/1999
EP 0926879A 2 6/1999
EP 0730953 B1 8/2000
WO WO02/35286A 1 5/2002

* cited by examiner

*Primary Examiner*—Thinh Nguyen

(57) ABSTRACT

Methods and apparatus for packing, including single pixel data strings, and playback tracking of informative data, e.g., audio signals, associated with graphics. To maximize the signal-to-noise ratio during data recovery, a Read sensor is kept substantially on-center of each data block throughout reading. A Print-and-Read ink-jet embodiment carriage mechanism in conjunction with the paper feed mechanism keeps the Read sensor on track center as misalignment information has been determined beforehand or in real time for active track servoing. Additional functionalities are incorporated in scanning ink-jet class of printers so that they can further operate as informative data recovery or retrieval systems for digitized data on graphical data images. In another embodiment, a digital camera itself is provided with additional functionalities to operate as a recovery and playback device for prints containing informative data.

33 Claims, 7 Drawing Sheets

METHOD AND APPARATUS RELATED TO INFORMATIVE DATA ASSOCIATED WITH GRAPHICAL IMAGE DATA

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO AN APPENDIX

Not applicable.

BACKGROUND

1. Technical Field

This disclosure relates generally to data packing, data alignment, data tracking, and data retrieval for informative data printed in association with visible images.

2. Description of Related Art

Commercially available still-image digital cameras are now provided with the capability of recording added data, such as audio data, at substantially the same time as the image is made, permitting the photographer to create informative data associated with each image; e.g., subject, time, and place, camera settings, personal notes, and the like. Such audio data may be played back when viewing the images, either on the camera itself, through a dedicated data retrieval device, or simply through the audio system of a separate viewer, such as a television to which the camera is attached by appropriate cabling. Exemplary systems are described by the Kodak company in European Patent Application no. 98204128.7, claiming priority of Dec. 18,1997, U.S. Ser. No. 09/994,000, "Recording audio and electronic images," and European Patent Application no. 98293451.4, claiming priority of Oct. 28, 1997, U.S. Ser. No. 09/959,041, "Methods and apparatus for visually identifying an area on a photograph or image where digital data is stored;" both incorporated herein by reference. Kodak's systems prefer non-visible ink when printing data other than that of the image itself.

While digital photographic images are readily printed and shared, the added informative data, such as contemporaneously captured audio data, is much more difficult and cumbersome to share. Talking photograph albums are known in the art, but require inserting each photograph of interest, taken at a prior time, into the album and then recording a message for each in a digital audio recording apparatus built into the album. These devices do not permit substantially simultaneous recording of the image data and the added informative data.

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in *Output Hardcopy* [*sic*] *Devices*, chapter 13 (Ed. R. C. Durbeck and S. Sherr, Academic Press, San Diego, 1988). Scanning printhead ink-jet printing apparatus are commercially available. The scanning carriage may carry other sensors used for monitoring various parameters and characteristics related to ink-jet printing functions. For example, Steven Walker, in U.S. Pat. No. 6,036,298, issued Mar. 14, 2000, shows a "Monochromatic Optical Sensing System For Inkjet Printing" (referred to hereinafter as "Walker '298"), assigned to the common assignee hereof and incorporated herein by reference in its entirety, including all related continuation, continuation-in-part, and divisional applications.

There is a need for systems and methods for informative data packing, data alignment, data tracking, and data retrieval.

BRIEF SUMMARY

The basic aspects of the invention generally provides for methods and apparatus related to informative data accompanying printed visual image data.

One aspect is an image printing method including: receiving image data; receiving informative data associated with said image; generating data representative of at least one printable alignment indicator for said informative data; and during a single pass of a single print medium through a printing zone, printing thereon said image data and said informative data with said alignment indicator proximate thereto.

Another aspect is a graphical print including: an image area; and a data area containing data information associated with said image, wherein said data area includes at least one data block and at least one marker formed substantially concurrently therewith and providing alignment registration indicia for reading said data block from said print wherein said indicia are situated and constructed for calculating alignment of said data relative to a predetermined path of a read sensor traversing said data block.

Another aspect is scanning ink-jet print and read apparatus, having a printing zone, the apparatus including: controlling mechanisms for operating a plurality of functions of said apparatus; and connected to said controlling mechanisms, transport mechanisms for moving a printing medium through said printing zone, adjacent to said printing zone, carriage mechanisms for scanning in a first axis across said medium when transported in a second axis substantially perpendicular to said first axis through the printing zone, connected to said carriage mechanisms, encoding mechanisms for tracking position and velocity of said carriage mechanisms during said scanning, fixedly mounted to said carriage mechanisms, printhead mechanisms for printing images and alphanumeric characters on said medium, fixedly mounted to said carriage mechanisms, sensing mechanisms for reading pixels on said medium, and playback mechanisms for rendering digital audio data printed in predetermined ones of said pixels.

Another aspect is a method of aligning a data set to a data reader, the method including: printing a photographic image on a sheet of paper; concurrently to said printing a photographic image, printing on said sheet of paper as said data set, audio data recorded substantially concurrently with making said photographic image; concurrently to said printing audio data, printing alignment indicia proximate the data set wherein said indicia is at least one predetermined character having a geometric association to said data set such that a positional relationship of said data set to a predetermined path of said data reader is defined thereby; when subsequently reading said audio data, from said indicia, calculating offset, skew, or both, characteristics of said data set to said predetermined path; and compensating for said offset, said skew, or both.

Another aspect is a method for aligning a linear audio data track for a subsequent track scanning read head adapted for reading the track printed proximate a substantially contemporaneously recorded and printed graphical image, the method including: aligning an approximate mid-height point of the read head wherein the read head has span greater than a height dimension of said track with an approximate centerline of said track; dithering said read head while traversing a predetermined length said data track and recording any change in vertical location of top-of-track, bottom-of-track, or both; calculating track skew from said change; and adjusting path-of-scan said read head for said skew for said subsequent track scanning read head during a subsequent reading of said track.

Another aspect is a method for aligning a linear audio data track for a subsequent track scanning, linear array detector adapted for reading the track printed proximate a substantially contemporaneously recorded and printed graphical image, the method including: when the detector has a span less than a height dimension of said track, aligning an approximate mid-height point of said detector to a linear edge of said track, or, when the detector has a span greater than a height dimension of said track, aligning an approximate mid-height point of said detector to a centerline of said track; detecting changes of output characteristics of said detector while scanning said track related to one or both linear edges thereof, and calculating track skew from said changes of output characteristics.

Another aspect is a graphical image print including: an image region having a dot matrix array of colored pixels forming a graphical image; an informative data region, wherein digital code is formed as individual pixels wherein an non-printed pixel is representative of a digital one or zero and a colored pixel is representative of a complementary digital zero or digital one, respectively, and wherein combinations of single pixels in a one-dimensional or two-dimensional array for digitally coded audio information; and at least one informative data region alignment marker for aligning a read head to said data region.

Another aspect is a print and read ink-jet apparatus including: mechanisms for printing digital data including data representative of graphical images and at least one field of digital audio data associated with said graphical images, wherein said digital audio data is printed with alignment indicia proximate thereto; and mechanisms for reading and playing said digital audio data and alignment indicia, wherein said alignment indicia is read prior to or in conjunction with said digital audio data for maintaining reading alignment between said mechanisms for reading and playing and said at least one set of digital audio data.

Another aspect is a photographic imaging system, including a digital camera having an audio recording and playback subsystem; and a printer for printing image data and audio data associated with the images recorded using said camera on a sheet medium, wherein said digital audio data is printed on said medium without interfering with visibility of said image data and with alignment indicia data proximate said audio data for maintaining reading alignment thereof and such that said alignment indicia is readable by said digital camera.

The foregoing summary is not intended to be inclusive of all aspects, objects, advantages and features of the present invention nor should any limitation on the scope of the invention be implied therefrom. This Brief Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches.

Like reference designations represent like features throughout the drawings. The drawings in this specification should be understood as not being drawn to scale unless specifically annotated as such.

DETAILED DESCRIPTION

Figure 12:
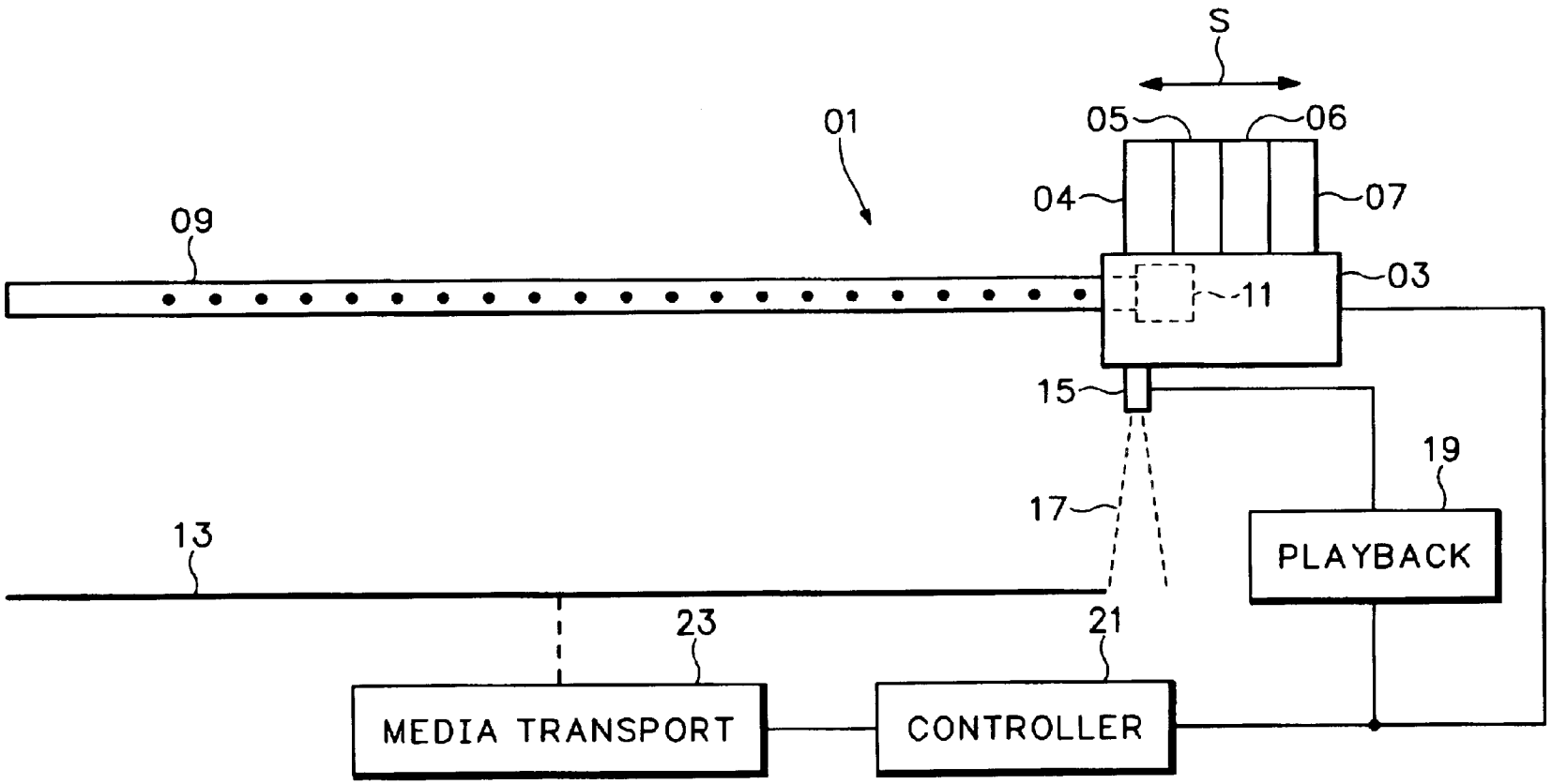
FIG. 12 is a schematic representation of a scanning ink-jet printing and data retrieval apparatus in accordance with an exemplary embodiment of the present invention and used in accordance with the processes as shown in FIGS. 2, 3A, 3B, 4, 5, 6, 7, 8, 9A, and 9B.

Ink-jet printing apparatus scanning carriages which carry both ink-jet printheads and associated sensing devices are well-known in the art (see Background section and Walker '298 cited therein). FIG. 12 is a schematic representation of a scanning ink-jet printing and data retrieval apparatus in accordance with an exemplary embodiment of the present invention. FIG. 12 is a schematic drawing illustrating fundamental elements of an ink-jet apparatus 01 which may be employed in accordance with the present invention. A carriage 03 has printheads 04, 05, 06, 07 fixedly mounted therein for printing on media 13 (lead edge or trailing edge view) moved by a media transport mechanism 23 through a print zone scanned by the carriage 03 as the printheads fire droplets of ink in a dot-matrix pattern to form images and alphanumeric text or other data patterns. An encoder strip 09 and velocity-position encoding detector mechanism 11 is provided for tracking speed and lateral position of the carriage 03 as it bidirectionally scans, represented by double-headed arrow "S," the printing zone and across the print media 13. A sensor 15 having a Read field-of-view 17 is also fixedly mounted to the carriage 03. Real time positioning of the sensor 15 is also performed with the encoder strip 09 and position encoding detector mechanism 11. A programmable application specific integrated circuit ("ASIC"), or microprocessor, based controller 21 provides for functionality and coordination of the apparatus subsystems. Appropriate digital decoding and playback, e.g., audio signal process, electronics 19 ("Playback") is incorporated into the pnr apparatus 01. The processes in accordance with the present invention may be implemented in the programming of the apparatus 01, in conjunction with the functional operations of the various subsystems thereof as will become apparent from the following descriptions of exemplary embodiments.

For convenience in describing the present invention, the ink-jet carriage 03 carrying both printheads 04–07 and a reading sensor 15 is referred to hereinafter as a Print-and-Read carriage, or more simply a "PnR carriage." An ink-jet apparatus 01 incorporating the present invention is referred to hereinafter as a Print-and-Read apparatus, or "PnR apparatus." The PnR carriage in accordance with the present invention may carry a specially adapted sensor or, "Read head," device such as described in assignee's Walker '298 patent, or it may use adapted commercially available discrete sensors. Typical, adaptable sensors and detectors include for example, photodetector mechanisms like the Perkin Elmer model FFD-100 photodiode, model VTT1015 phototransistor, or line-scan imagers such as their P-series linear photodiode array imagers and their L-series CMOS photodiode arrays. In accordance with the present invention, additional functionality are incorporated in the ink-jet class of printers and digital cameras so that they can further operate as informative data recovery, or retrieval, systems for digitized informative data added onto a printed sheet bearing associated, printed, digital data forming graphical images.

Technology for making digital images and storing image data with accompanying additional informative data is known in the art, e.g., a digital camera; no further description is essential to an understanding of the present invention. Data retrieval for showing the stored image and playback of added informative data, such as a contemporaneously stored audio track, via a speaker, is also known in the art, e.g., connecting the camera to an audio-video apparatus; no further description is essential to an understanding of the present invention.

For the purpose of describing exemplary embodiments of the present invention, the visual image data printed by the PnR apparatus is said to be a "photograph;" no limitation on the scope of the invention is intended by the inventors, nor should any be implied therefrom (see also, Background section hereinabove). As the PnR carriage traverses across the width of the photographic paper, one or more blocks of informative data may sequentially printed or, at a later time, retrieved, also referred to as "playback." The physical region where one linear segment of readable data is recorded will be called a "data track."

The PnR carriage is known to return to a starting position, e.g., a carriage stop, edge of media or the like, dependent upon whether the printing is unidirectional or bidirectional, getting ready for the next line of data. The paper feed mechanism will advance the photograph to the next line of data. Any transverse return motion for unidirectional printing may occur coincidentally or non-coincidentally with respect to the photographic paper motion. The data track(s) may be printed visibly, such as in a non-image border region of the print medium, or invisibly in a known manner so as not to interfere with the aesthetics of the printed image (see e.g., Kodak patent applications describe in the Background section hereinabove). Additionally, given an appropriate printhead arrangement or a media transport which allows duplexing of media sheets, such data track(s) may be printed on the reverse side of the sheet from the image side. To get a higher data recording density, both the width of data tracks and the track-to-track center spacing ("track pitch density") should be kept as small as possible. Narrow tracks at high track pitch density will make data recovery more difficult without some type of tracking mechanism. Alignment lines or marks described in accordance with the present invention will keep a Read head, or sensor, on-track during the retrieval process. The Read head may have a very small area of coverage, "field-of-view," relative to the widths of the data track and the data bits. Thus, for some embodiments it is contemplated that each printed informative data bit may in fact be only single picture element ("pixel), namely, having a one pixel track height; each pixel can be paper white—namely, non-printed—or colored, and therefore represent a digital one or digital zero data bit. It can be recognized as an advantage of the present invention that single pixel data packing is made possible. Track pitch density may be reduced accordingly wherein, if the point detector has a field-of-view of less than one picture element ("pixel"), even adjacent tracks may be separate data tracks. Note that as another advantage of the present invention, invisible inks and the like need not necessarily be employed as current ink-jet printing technology can present ink dot density in excess of 2000 dots-per-inch, i.e., invisible to the naked eye even if a single pixel line of alternating black-and-white dots are printed as informative digital data. Alternatively, a data track height incorporating several pixels or superpixel clusters may be employed.

Figure 1:
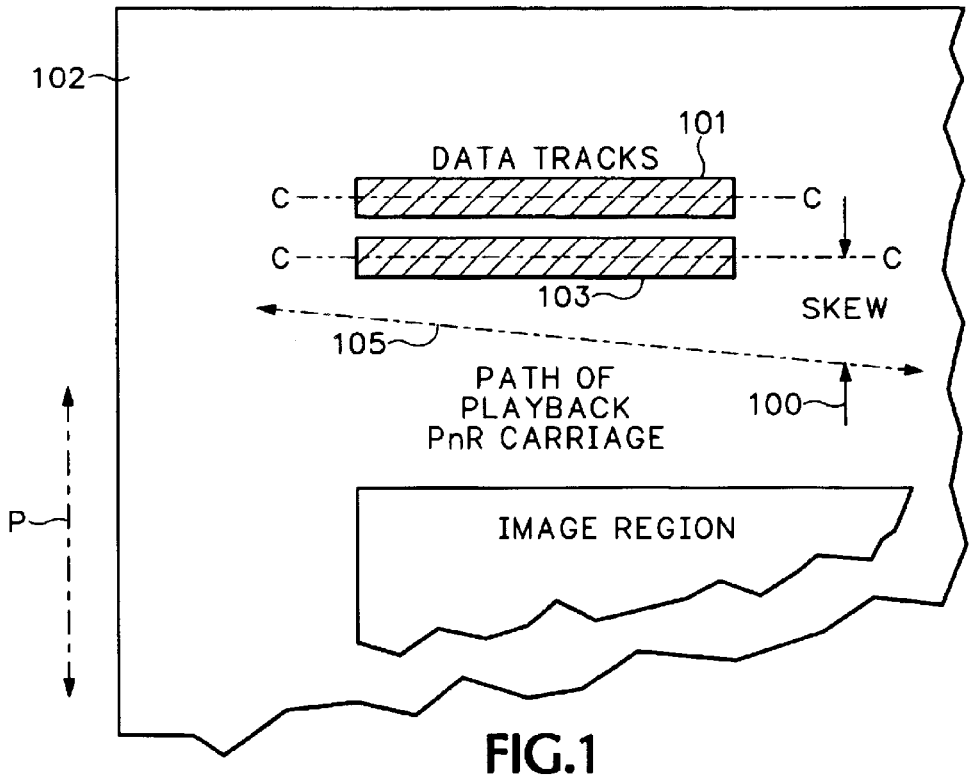
FIG. 1 is a depiction of informative data track skew, illustrating a problem in the state of the art.

While it is recognized that the informative data on the photographic print may have been printed on a different PnR apparatus than the one used to recover it, even if using the same PnR apparatus for playback of recorded audio data tracks, it would not be expected that at a high track pitch density such as contemplated by the present invention that the PnR carriage would accurately retrace the data that was laid on the photograph paper previously once it had been already ejected from the printer. In other words, once the photograph is disengaged from the paper feed mechanism, misalignment is likely to happen when the photograph is fed back even into the same printer for an audio playback. FIG. 1 is a depiction of informative data track skew, illustrating a problem in the state of the art. It can be readily recognized that for an accurate reading of a data track 101, 103, the reader must preferably be straddling the centerline C—C of the tracks. Also, FIG. 1 shows the possibility of a skew 100 between the centerline C—C of each data field 101, 103 printed on the photographic media 102 and the locus of the new path 105 of the PnR carriage projected on the photographic media.

To determine the amount of misalignment so it can be corrected before or during data recovery, in accordance with exemplary embodiments of the present invention one or more of alignment indicators, or indicia, are printed on the photograph in conjunction with the informative data at the same time each data track is being printed. These alignment indicators will give information and act as tools so as to enable the PnR carriage to adjust to offset the skew during informative data recovery.

Figure 2:
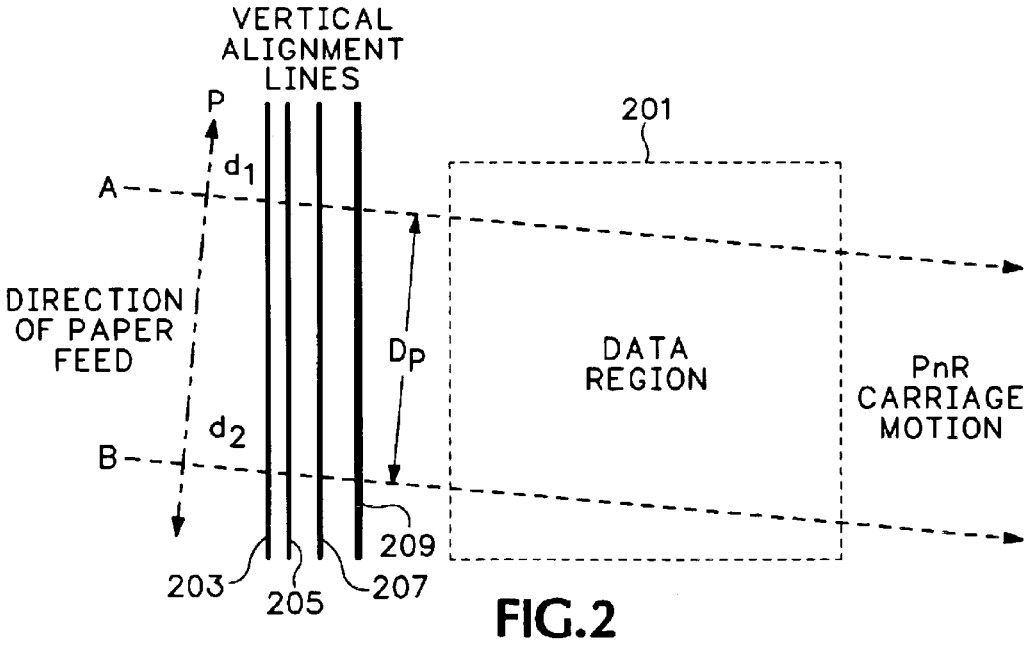
FIG. 2 is a schematic depiction an of informative data alignment-realignment process in accordance with a first exemplary embodiment of the present invention.

FIG. 2 is a schematic depiction an of informative data alignment-realignment process in accordance with a first exemplary embodiment of the present invention. In FIG. 2, let a schematic Data Region 201 represent a printed informative data track, or plurality of tracks, on a photograph or in a border margin of the photographic paper. Arrows labeled A and B represent a subsequent insertion, PnR carriage motion, while arrow P represents paper feed directionality. Alignment indicators 203, 204, 205, 207 have been printed concurrently and proximate to the Data Region 201. In this embodiment, vertical alignment line, "VAL" indicators 203, 205, 207, 209 are employed, which may have varying inter-line spacing, varying thicknesses, or both, as shown.

During informative data reading, while the PnR carriage is at or near the top of the vertical alignment lines and traversing with PnR Carriage Motion A, distance d, is determined as the sensor on the carriage moves across the page in one or more passes, where d, may be for instance the distance in the axis of carriage motion from the edge of the paper, or from the carriage stop, or from any fixed, known, carriage position determined from the encoder subsystem (see FIG. 12 and related description, hereinabove) to a predetermined one of the VAL indicators, e.g., line 203. Depending on the degree of accuracy desired and which may be related to the track pitch density, several determinations may be desirable, e.g., $d_1$ from the paper edge to VAL 203, $d_1$ from the paper edge to VAL 205, et seq. Similarly, after an appropriate paper advance and while scanning PnR Carriage Motion B at or near the bottom end of the VAL indicators 203, 205, 207, 209, distance(s) $d_2$ is measured. The measured difference value(s), $d_1$–$d_2$, is a factor suitable for calculating the degree of skew in the paper feed direction, P. The skew in the paper feed direction in the measurement of the skew angle Θ is then:

$$\Theta=\tan^{-1}(d_2-d_1/Dp), \qquad \text{(Equation 1)}$$

where Dp is the separation between the PnR carriage motions A, B in the paper feed directions P as shown in FIG. 2. In most cases, the skew in the PnR carriage direction is close to the skew in the paper feed direction since, by design, the paper feed direction is generally orthogonal to that of the PnR carriage motion. Manufacturing tolerance may case slight deviations from design specifications. Where more than one top of VAL distance, $d_1$, and bottom of VAL distance, $d_2$, is determined, an average, median, or other value may be used for skew determination. Once the skew is determined, a correction factor is calculated in a known manner and coordinated to the PnR carriage scan drive and paper feed as it moves across the page to retrieve the data on each data track of region 201. In other words, if skew is significant enough such that a specific informative data track will be lost to the field-of-view of the sensor as it is scanned across the Data Region 201, compensation is applied to adjust the paper position accordingly as the data is read, namely, reading the data and playing the audio in a seamless manner.

It may be recognized that nominally the PnR carriage motion A, B (x-axis) is perpendicular to the direction of the paper feed P (y-axis). If the actual angle between the direction of the paper feed and the PnR carriage on the printer that first produce the photograph is almost the same as that on the printer that performs data recovery, the above correction might be sufficient to minimize the PnR carriage skew in retrieving the informative data. If the skew correction is not adequate using this embodiment of VAL indicators method because the two angles differ too much, the following methods will overcome this further problem.

Figure 3A:
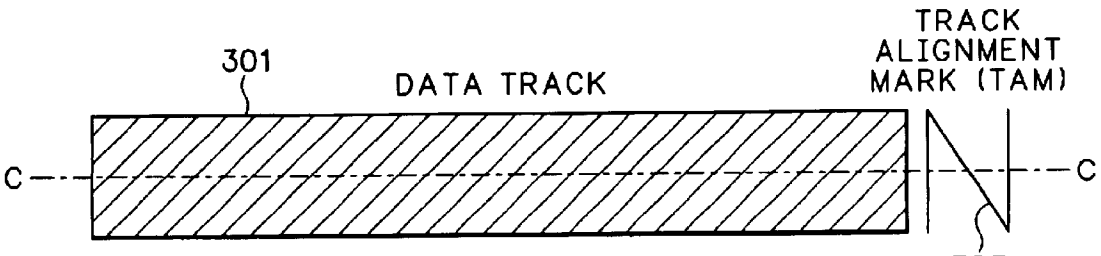
FIGS. 3A and 3B are schematic depictions of informative data alignment-realignment processes in accordance with another exemplary embodiment of the present invention.
Figure 3B:
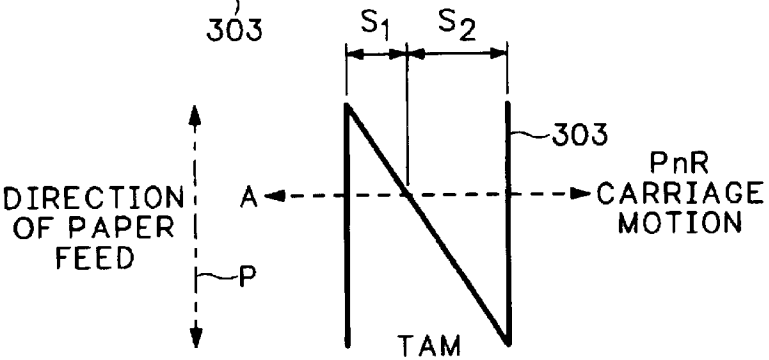

FIGS. 3A and 3B are schematic depictions of informative data alignment-realignment processes in accordance with another exemplary embodiment of the present invention. A linear informative data track 301 is shown as having a centerline C—C. As in FIG. 2, carriage motion is represented by arrow A; print media motion is represented by arrow P. Concomitantly with the recording of the informative data track 301, at least one Track Alignment Mark ("TAM") indicator 303 is printed. The TAM indicator 303 is a predetermined relative horizontal design, here the alphabetic character letter "N," printed such that the centerline C—C is also through the centerline of the design and having a feature, here the slash piece of the "N," which when read across various horizontal planes thereof provides a tool for measurement representative of offset from the centerline in the current respective relative vertical.

Looking to FIG. 3B, upon reinsertion and feed of the paper through a PnR apparatus for informative data playback, the measurements of the read design in the current orientation to the read sensor, that is, the difference between S1 and S2, is an indication of how much the read sensor is off from the centerline C—C. In other words, given the known dimensions of the design, by using the sensor to measure S1 and S2 during a current carriage motion "A" scan, the vertical displacement of the read sensor from the centerline C—C of the data track is also measured. Using this indication, paper feed can be advanced or reversed to achieve an optimum data reading path straddling the centerline such that dithering of the paper during playback is not required. A TAM indicator 303 may be placed at the beginning, the end, or both ends of the data track 301. Note that by placing a TAM 303 at both ends of the data track 301, a pair of S1, S2 measurements—namely (S1–S2) at the beginning-of-track, and (S1–S2) at the end-of-track—can also be used to calculate skew, if any, of the data track between centerline C—C and new path of carriage motion "A" versus the printing carriage path. If it is determined that skew is such that the field-of-view of the sensor will leave a given data track during one-pass scanning, dithering of the paper can again be employed.

Figure 4:
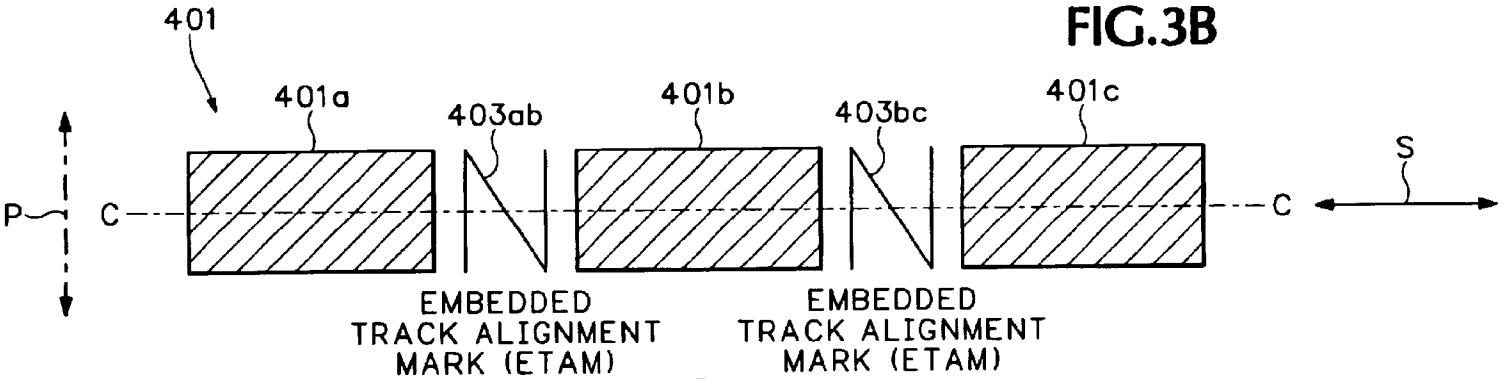
FIG. 4 is a schematic depiction of an informative data alignment-realignment process in accordance with a variant of the exemplary embodiment of the present invention as shown in FIG. 3.

FIG. 4 is a schematic depiction of an informative data alignment-realignment process in accordance with a variant of the exemplary embodiment of the present invention as shown in FIG. 3. In order to achieve better track servoing performance, more track misalignment information may be generated and acquired for each data track 401. A series of S1, S2 measurements (see FIG. 3B) is obtained for each data track 401 by embedded TAM ("ETAM") indicators 403*ab*, 403*bc*, et seq., among recorded segments 401, 401*a*, 401*b*, also referred to as "data fields," of the informative data track 401. These measurements can be pre-analyzed by doing a Read signal scan along a nominal centerline C—C (see also, e.g., FIG. 6 described hereinbelow), or can provide closed-loop on-going, or real-time, error signaling as the data track 401 is being read. In other words, there are a plurality of alignment markers $\mathbf{403}_{x,y}$ printed at predetermined positions of the data track 401, interspersed with individual data fields $\mathbf{401}_{x,y}$ thereof, such that a current offset-from-centerline value can be determined at each of said markers, thus providing a factor for also calculating skew value for feedback to active track servoing using the paper feed mechanism as soon as two or more ETAM indicators have been read and analyzed.

Note that both VAL indicators 203, 205, 207, 209, FIG. 2, and TAM indicators 303, $\mathbf{403}_{a,b,c\ldots y}$ may be used simultaneously and interchangeably. For example, horizontally printed VAL indicators can be employed for track misalignment measurements and correction factor calculations. The letter "Z" for example may be used as a TAM or ETAM marker for vertical offset and skew detection and correction. Combinations of the two may be employed.

Figure 5:
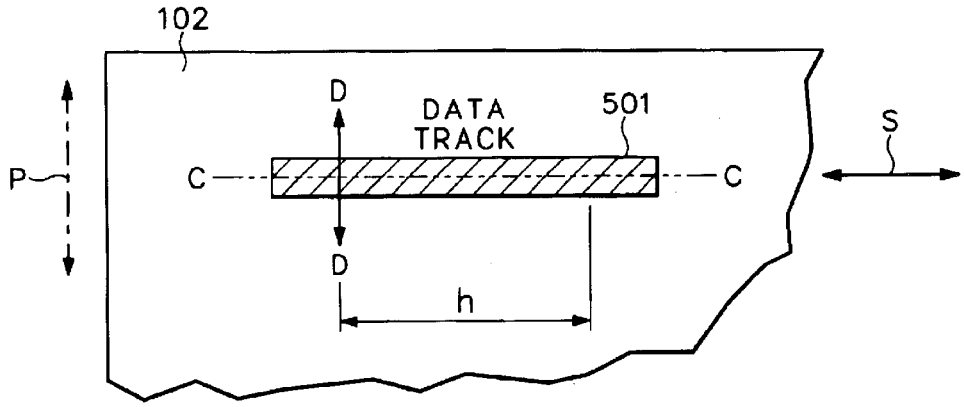
FIG. 5 is a schematic depiction of an informative data alignment-realignment process in accordance with another exemplary embodiment of the present invention.

FIG. 5 is a schematic depiction of an informative data alignment-realignment process in accordance with another exemplary embodiment of the present invention, a data track envelop detection process. In the data track envelop detection method, the top and bottom edges of a data track 501 are used as the alignment indicators to determine the track skew relative to the motion of the PnR carriage. In an initial alignment pass of the carriage along the nominal centerline C—C (see also, e.g., FIG. 6 described hereinbelow), the sensor is dithered substantially orthogonally with respect to the data track 501, represented by double-headed arrow "D—D," so as to locate the envelop, or extent, of the data track along the paper path direction. For example, to dither the Read head, or sensor, orthogonally with respect to the motion of the PnR carriage during the alignment pass, the photographic paper 102 would feed back and forth under the control of the paper feed mechanism—again illustrated by arrow P. The vertical displacement of the edges of the data track at two or more places separated by some horizontal distance, "h," along its length would determine the amount of track skew. It will be recognized by those skilled in the art that in this and the other described embodiments herein, multiple alignment passes may be employed; it may be advantageous to use multiple passes in order to reduce measurement errors.

Figure 6:
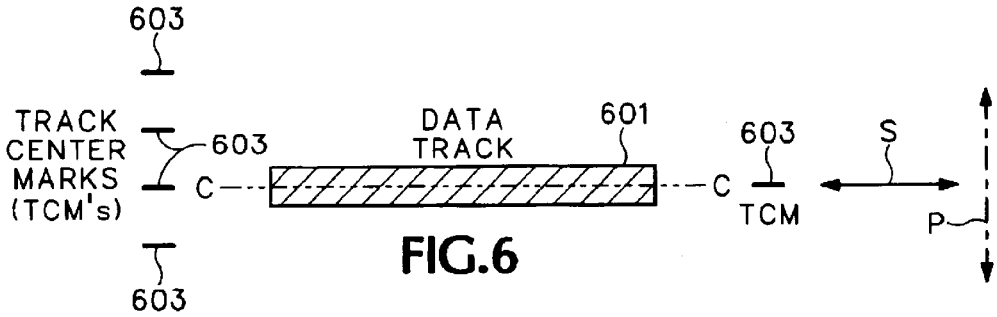
FIG. 6 is a schematic depiction of an informative data alignment-realignment process in accordance with an auxiliary process for pre-estimating a data track centerline, useful in other disclosed exemplary embodiments of the present invention.

FIG. 6 is a schematic depiction of an informative data alignment-realignment process in accordance with an auxiliary process for pre-estimating a data track centerline, useful in other disclosed exemplary embodiments of the present invention. As nominal centerline C—C knowledge is important to several of the methodologies described herein, associated with each data track there could be printed a Track Center Mark ("TCM") indicator 603 which is laid down proximately to the start of each data track 601 (unidirectional or bidirectional) at the time the informative data is being printed on the photographic print media. The TCM indicator 603 will facilitate a PnR carriage search for and location of the centerline C—C of each data track 601 in the first stage of a data retrieval process. The field-of-view of the Reading device is positioned to straddle the TCM indicator 603 for the nominal centerline C—C of the data track 601 before attempting to read the informative data contained therein. Note that if the maximum skew is estimable, and the track heights and track densities tailored accordingly, and using a sensor with an appropriate field of view, using the TCM indicator 603 as the alignment mark may be sufficient to allow playback without any further requirement for active skew compensation.

Figure 7:
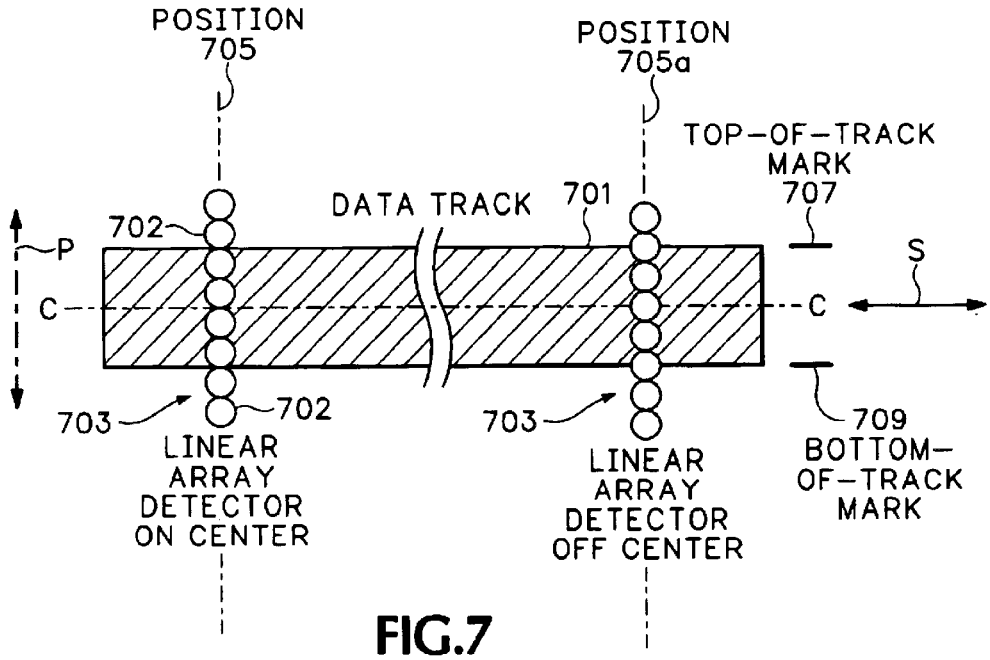
FIG. 7 is a schematic depiction of an informative data alignment-realignment process in accordance with another exemplary embodiment of the present invention.

FIG. 7 is a schematic depiction of an informative data alignment-realignment process in accordance with another exemplary embodiment of the present invention. In this exemplary embodiment of the present invention, a linear array detector 703 is employed as a Read head. The linear array detector 703 is made up of a multiplicity of "point" detectors 702 arranged in a linear, or one-dimensional, array. Each point detector performs independently, producing a read-back signal according to the imaging area each detector covers. In the implementation of FIG. 7, the linear array detector 703 is wider than the width of the data track 701 so it will nominally straddle the width of the entire data track; i.e., the paper transport can dither the paper until the detector 703 is in alignment shown at position 705. As depicted in FIG. 7, by comparing detector 703 output at position 705 and position 705*a,* the data pattern the linear array detector 703 reads will vary if the PnR carriage is not moving parallel to the data track 701 centerline C—C. Since the linear array detector 703 is wider than the data track 701, the amount of skew can be determined by analyzing the signals from each individual detector 702 in the array. With a full width linear array detector, it is also possible to incorporate 2-D data coding, discussed hereinbelow. As with FIG. 6, alternatively to using the data track itself, separate alignment indicators could be generated and printed for designating a top-of-track alignment mark 707 and bottom-of-track alignment mark 709, positioned at one end or at each end of the data track 701, wherein these indicators become the two skew check positions.

Figure 8:
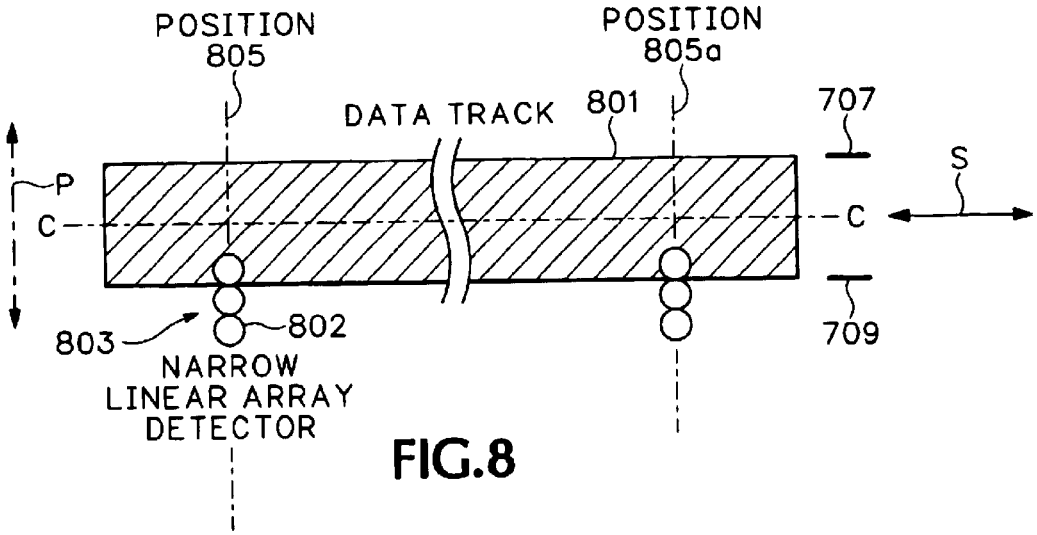
FIG. 8 is a schematic depiction of an informative data alignment-realignment process in accordance with another exemplary embodiment of the present invention.

FIG. 8 is a schematic depiction of an informative data alignment-realignment process in accordance with another exemplary embodiment of the present invention. In this further exemplary embodiment of the present invention, similar to that in FIG. 7, the embodiment has a linear array detector 803 with a span less than the data track 801 height. When the linear array detector 803 is smaller than the data track 801 height, in order to determine the amount of skew, first one edge—top or bottom—of the data track is found by dithering at a first position 805 along the length of the track 801. Then, the linear array detector 803 is positioned over that edge and a pass in the scan axis, S, over the data track 801 is made. Provided the data track skew is not too much in relation to the width of the array, a single pass will be enough to capture the degree of the skew; e.g, as shown, the output of the top element 802 of the narrow linear array 803 by the time it has reached position 805*a* will have changed due to the relative vertical shift with respect to the data track centerline C—C. If the skew of the initially captured edge is more than the size of the array, the skew could still be measured; the paper could be advanced or reversed along axis P by a known distance while the detector is partway along the data track 801.

Figure 9A:
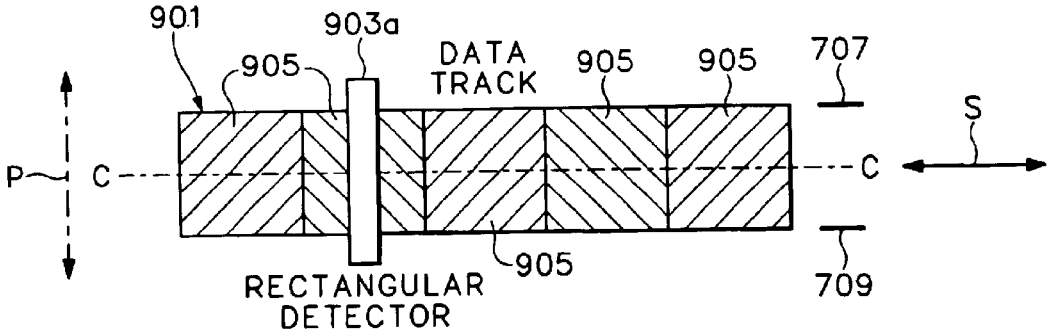
FIGS. 9A and 9B are schematic depictions of informative data alignment-realignment processes in accordance with a variant of the exemplary embodiment of the present invention as shown in FIG. 8, adapted for single pixel data packing.
Figure 9B:
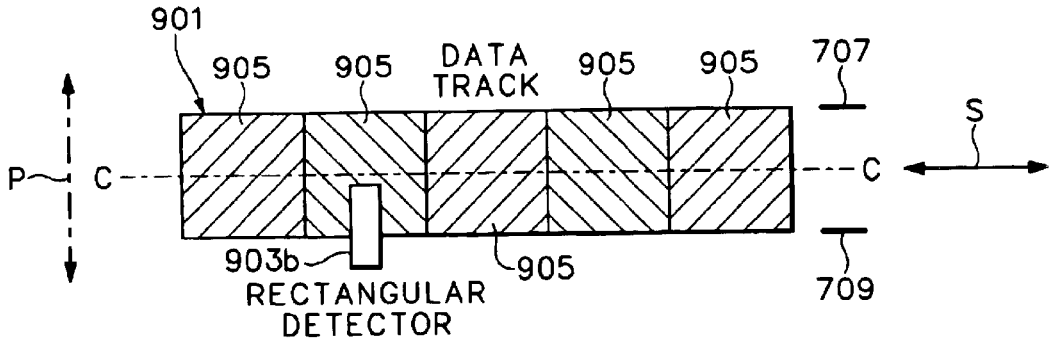

FIGS. 9A and 9B are schematic depictions of informative data alignment-realignment processes in accordance with a variant of the exemplary embodiment of the present invention as shown in FIG. 8, adapted for single pixel data packing. This illustrates a similar embodiment to FIGS. 7 and 8, but implemented using slit detectors 903*a*, 903*b*. The fundamental methodology is identical to FIG. 8. It will be recognized by those skilled in the art that this implementation is conducive to use of a single pixel height informative data track 901. Each pixel 905 comprises a digital data bit by being printed with a color dot of ink or non-printed, paper white.

Figure 10:
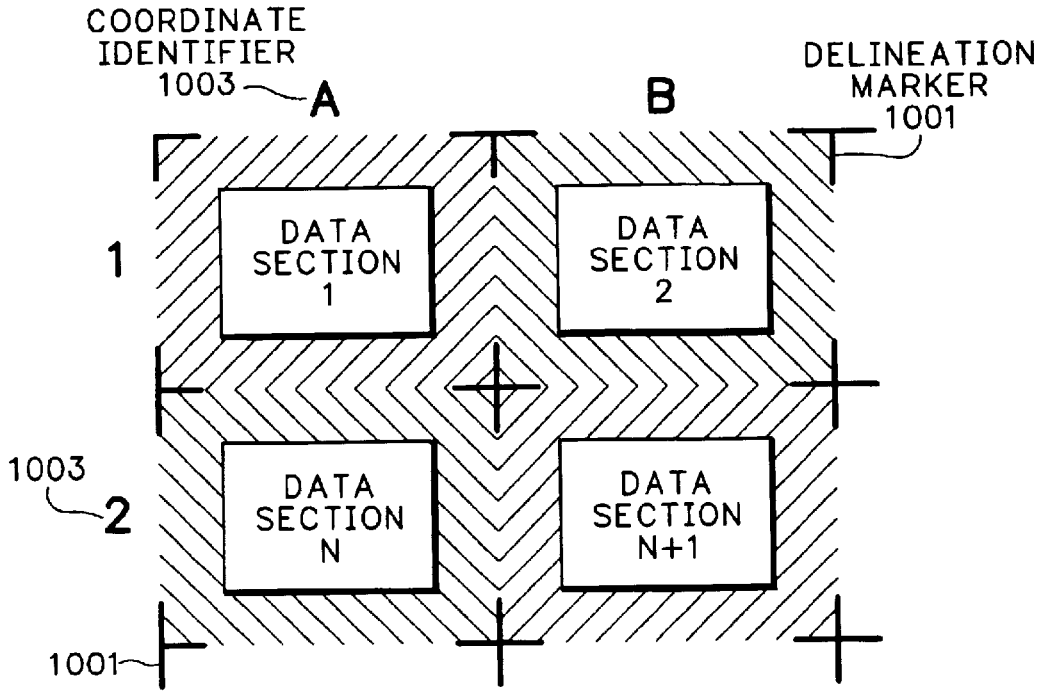
FIG. 10 is a schematic depiction of an informative data alignment-realignment process in accordance with another exemplary embodiment of the present invention.

FIG. 10 is a schematic depiction of an informative data alignment-realignment process in accordance with another exemplary embodiment of the present invention. A digital camera (not shown) itself can be made to function as an informative data recovery device. When the informative data region is rendered on the print media in the visible spectrum, the user can focus the camera on the data region, frame it, and take an image of the region. In one single exposure, a large amount of data is captured substantially instantaneously, allowing a large area block data recovery method. The captured image in the camera, viz, a digital photo of the data block itself, is next converted in a known manner to digital data, which is decoded to produce the audio signal from the built-in loudspeaker in the camera.

Note that if the data region is outside the visible spectrum, an illumination source (e.g., infrared, ultraviolet or the like) provided in the camera must be turned on to aid the data capture process. The illumination source would render the data region visible to the image sensor in the camera, which would in turn display the recovered image on its liquid crystal display ("LCD") screen so the user could visualize the prerecorded but otherwise invisible data region.

In order to cover a larger data region to read in more data, and thus allow a longer audio data file, multiple exposures might be necessary. This is because the camera has a finite spatial resolution which must be overcome. The process starts with the user taking successive, overlapping images of the entire data region a section at a time. Once the entire data region has been captured piecemeal, data stitching software in the camera would piece the images together forming a much larger data file. To help the user making overlapping exposures, the data sections are delineated by some type of alignment indicators 1001, "Delineation Markers," which are again as in previous embodiments laid down at the same time when the photograph is being printed. Note that alternatively, instead of just Markers at the corners, the data sections may be enclosed by delineation borders in which data section information, such as coordinate identification, may also be encoded and embedded, "Encoded Delineation Markers." In other words, the markers themselves may have functional alignment data or information embedded therein. Such camera-readable section identification may help the data retrieval process. For example, the user does not need to retrieve the data sections in a particular sequential order, though that is a logical task. If for some reason any particular section is not correctly captured, e.g., out-of-focus, the camera could inform the user such data section needs to be re-captured. Besides the section coordinates, information about the data organization, e.g., array partitioning information, may be and preferably is included in the delineation border. "Coordinate Identifiers," 1003, e.g., A, B, 1, 2, matrix designations, on the periphery of the macro data region made up of the annotated "Data Sections" would further help the user to keep track of and identify what data section to image and in what logical order. It is also possible to effectively accomplish the same goal of large area block data recovery by a slight variant. Instead of requiring the user to take one or more exposures of the data regions, the camera could be designed in ways that a series of shots will be automatically taken as the camera is moving over the data regions while the shutter is being depressed. In other words, the images are being captured in a motor drive, or stroboscopic, mode.

In accordance with FIG. 10, the data retrieval process in this scheme is a block access method, as opposed to a sequential access 9 method used in a conventional scanning scheme such as described in accordance with FIGS. 1–9B. This large area block data recovery scheme fully takes advantage of the camera's field of view which is much larger than that of a typical read-back head, or other sensor, in a conventional scanner. Block access is in essence a parallel operation, and thus offers a much higher data capture rate. From a user's point of view, there are several important advantages in the large area block data recovery scheme described here. The most obvious and highly desirable advantage is the convenience this method and extra functionality incorporated into the camera provides since a dedicated data retrieval and playback device is not needed. The procedure to retrieve the data is also very straightforward and simple. Inherent in the block access method, it could acquire the data much faster. For example, for small data regions all it takes is a single aim-and-shoot operation. Low cost of implementation is another important benefit.

The fact that the camera is imaging an area at an instant in time, as opposed to sequentially retrieving data a line at a time, could be exploited advantageously in encoding the data. One-dimensional coding goes hand-in-hand with the conventional scanning scheme because it is very difficult and not cost-effective to spatially synchronize several data scans taken over some time interval. On the other hand, in imaging an area the spatial relationship between every pixel and its neighbors is precisely preserved within the limit of the resolution of the camera's optics and the image sensor. The pixels could be grouped in units of a predetermined two dimensional ("2-D") array in which the data is eventually encoded and decoded. The advantages of a 2-D coding scheme are that it would result in a better SNR, higher data coding density, or both, in addition to the ability to produce a more robust code that is less prone to error. In such prints, because of the larger amount of room that may be taken up by extensive data, it may be preferable to print the informative data, Delineation markers 1001, and Coordinate Identifiers 1003 invisibly and to provide the camera with a mechanism for illuminating as described hereinbefore.

Figure 11:
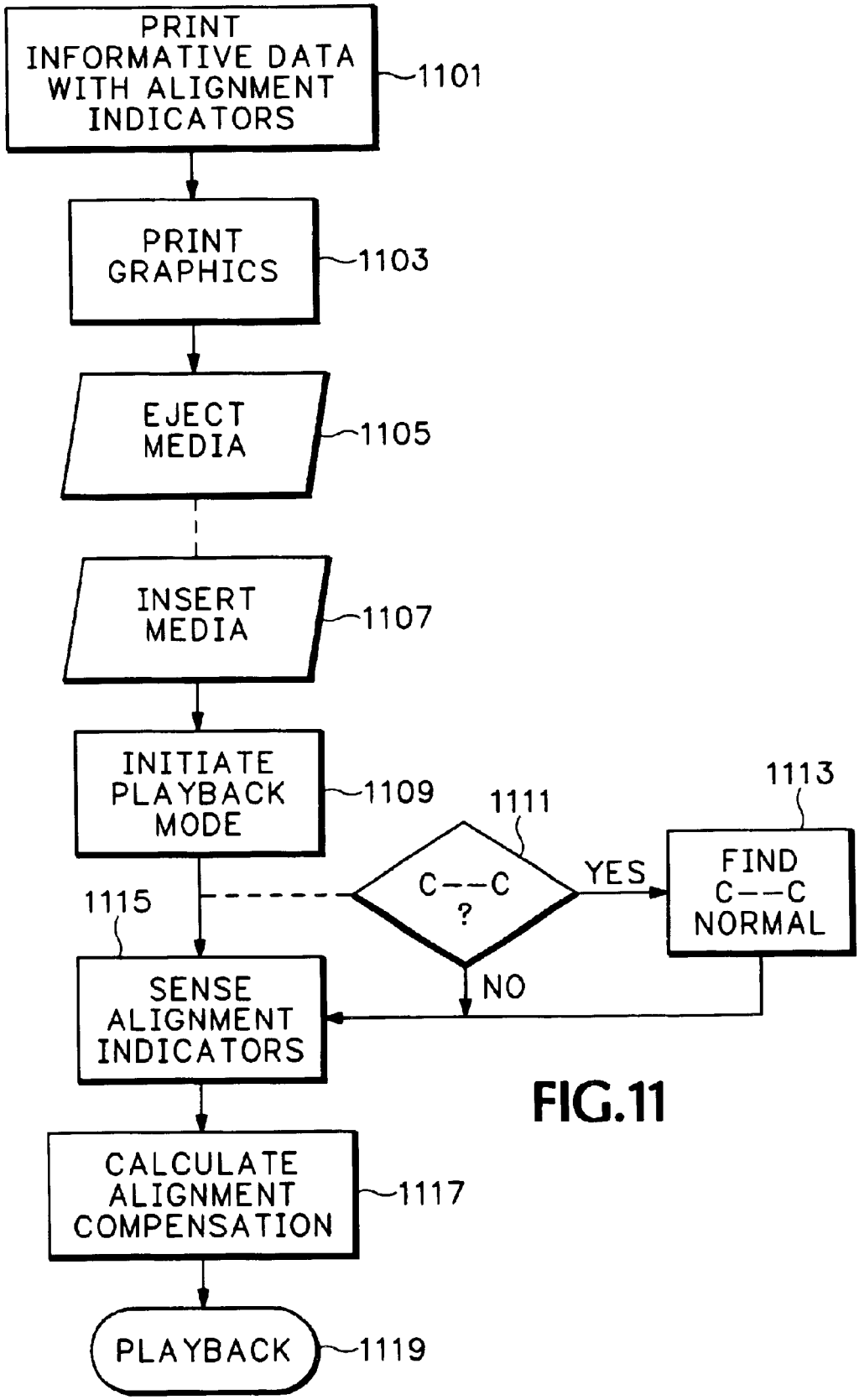
FIG. 11 is a generic process flow chart in accordance with the basic aspects of the present invention.

FIG. 11 is a process flow chart depicting a generic methodology in accordance with the present invention. In accordance with the present invention, the informative data is printed with alignment indicators, 1101. On the same media, the graphics data is printed in a known manner, 1103. The digital data which contains information and print graphics data may be printed in any order. The essential step is the concomitant printing of the informative data tracks and proximate alignment indicators. The printed sheet is ejected, 1105, from the PnR apparatus (see FIG. 12).

At some later time, whenever it is the user's desire to playback the informative data, the media is inserted, 1107, into the same, or a compatible, PnR apparatus. In accordance with known manner controls and programming of such apparatus, a "Playback Mode" is initiated, 1109.

Optionally (indicated by phantom line connection), if one of the embodiments requiring a centerline approximation is required to pre-position the informative data detector (see FIG. 1, element 15, and FIG. 6), or if a TCM 603 is employed as a primary alignment indicator for the data track, 1111, YES-path, a search for such a first TCM 603 is employed, 1113. Next, an alignment indicator is sensed, 1115. Once acquired, the skew measurements described hereinbefore can be respectively determined and alignment compensation calculated, 1117.

Once appropriate compensation is programed into the PnR apparatus, playback is commenced, 1119. The playback should be seamless as any offset or skew of the informative data relative to the read head will be compensated.

It should also be recognized that since the data is coded digitally, it is possible to multiplex stereophonic signals into a single channel for higher fidelity, multichannel separation playback.

In general, certain options are preferred. Whenever possible, track alignment should be applied to every track as it is being read. The initial determination may be off by a certain amount by the time some distance from the initial tracks is achieved. As each track is scanned, track misalignment information should be collected and applied to the following scans. Moreover, it will be recognized that scanning and capturing all the data tracks, or at least filling the available buffer(s), before playback of audio is advantageous for a continuous, clean sound reproduction.

It should be noted that data retrieval may occur in a bi-directional process. Data format information may be included in a header field at the beginning of the data region, containing any pertinent information other than the audio data itself, such as date/time created, name of creator, whether the data is coded as stereophonic or monophonic, whether the data is bi-directional or uni-directional, data rate, length of the recording in time, length of the data in bytes, and the like.

In a variety of embodiments and implementations, the basic aspects of the present invention relate to a method and apparatus for data packing, including single pixel data bit forms, and playback tracking of informative data associated with graphics images. To maximize the signal-to-noise ratio (SNR) during data recovery, and hence minimize the Read error rate, the Read sensor is kept on-center of each data track throughout the reading process. During the data recovery process, a Print-and-Read ink-jet embodiment carriage mechanism in conjunction with the paper feed mechanism keeps the Read sensor on track center since the misalignment information has already been determined beforehand or in real time for active track servoing.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. It will be recognized by those skilled in the art that this technology may also be employed in other graphics computing, e.g., digital art images wherein the computer artist similarly records associated non-visual information while creating a particular image. Applicant has made this disclosure with respect to the current state of the art, but also contemplates advancements during the term of the patent, and that adaptations in the future may take into consideration those advancements, in other word adaptations in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . ."

What is claimed is:

1. An image printing method comprising:

receiving image data;

receiving informative data associated with said image;

generating data representative of at least one printable alignment indicator for said informative data; and during a single pass of a single print medium through a printing zone, printing thereon said image data and said informative data with said alignment indicator proximate thereto, wherein each said alignment indicator is configured on said medium such that subsequent reading of said indicator provides a factor for calculating skew of a proximate track of said informative data with respect to a predetermined path of a reading sensor.

2. The method as set forth in claim 1 wherein each said alignment indicator comprises a plurality of markers printed at predetermined positions within said track, interspersed with data fields thereof, such that each said factor is used for feedback to activate track servoing.

3. The method as set forth in claim 1 wherein each said alignment indicator provides a reference for calculating dither required to keep a data sensor approximately centered on a track of said informative data during a reading of said informative data.

4. The method as set forth in claim 1 wherein each said alignment indicator is aligned with a lateral edge of a track of said informative data.

5. The method as set forth in claim 1 wherein said alignment indicator includes a plurality of lines printed adjacently to a track of said informative data at a predetermined position with respect to a reference associated with a path of the print media through the printing zone.

6. The method as set forth in claim 1 wherein each said alignment indicator is at least one character having a predetermined relative horizontal design, printed such that a centerline of a track of said informative data is also through a horizontal centerline of the design, said design further comprising a feature which when read across various horizontal planes thereof provides a tool for measurement representative of a current offset from the centerline in a respective relative vertical.

7. A scanning ink-jet print and read apparatus, having a printing zone, the apparatus comprising:

controlling means for operating a plurality of functions of said apparatus; and connected to said controlling means, transport means for moving a printing medium through said printing zone, adjacent to said printing zone, carriage means for scanning in a first axis across said medium when said medium is transported in a second axis substantially perpendicular to said first axis through the printing zone, connected to said carriage means, encoding means for tracking position and velocity of said carriage means during said scanning, fixedly mounted to said carriage means, printhead means for printing images and alphanumeric characters on said medium, fixedly mounted to said carriage means, sensing means for reading pixels on said medium, and playback means for rendering digital audio data printed in predetermined ones of said pixels.

8. The apparatus as set forth in claim 7 wherein said sensing means has a field-of-view less than a largest cross-sectional dimension of a pixel rendered by said printhead means.

9. The apparatus as set forth in claim 7 wherein the apparatus includes a printing mode including the printing of the digital audio data representative of information associated with an image printed on a same sheet of print medium.

10. The apparatus as set forth in claim 7 wherein the apparatus includes a playback mode including the rendering of audible signals obtained via said sensing means from said digital audio data representative of information associated with the image.

11. The apparatus as set forth in claim 7 further comprising:

playback marking means for printing alignment indicators on said medium proximate to the digital audio data.

12. The apparatus as set forth in claim 11 further comprising:

dithering means for dithering said transport means for aligning said sensing means to said digital audio data using said alignment indicators.

13. The apparatus as set forth in claim 11 wherein said sensing means is a point detector.

14. The apparatus as set forth in claim 11 wherein said digital audio data is a linear track and said sensing means is a linear array detector having a predetermined height associated with a height dimension of said linear track.

15. The apparatus as set forth in claim 11 wherein said digital audio data is a linear track and said sensing means is substantially a slit detector having a predetermined height associated with a height dimension of said linear track.

16. The apparatus as set forth in claim 7 wherein said controller functionally determines and compensates offset, scanning path skew, or both, of said sensing means with respect to a centerline of said digital audio data during reading thereof.

17. A method of aligning a data set to a data reader, the method comprising:

printing a photographic image on a sheet of paper;

concurrently to said printing a photographic image, printing on said sheet of paper as said data set, audio data recorded substantially concurrently with making said photographic image;

concurrently to said printing audio data, printing alignment indicia proximate the data set wherein said indicia is at least one predetermined character having a geometric association to said data set such that a positional relationship of said data set to a predetermined path of said data reader is defined thereby;

when subsequently reading said audio data, from said indicia, calculating offset, skew, or both, characteristics of said data set to said predetermined path; and compensating for said offset, said skew, or both.

18. The method as set forth in claim 17 wherein said alignment indicia is a plurality of said at least one predetermined character, said plurality aligned with a centerline of said data set and separating individual data fields of said set such that closed loop feedback indicative of skew of said data set to said predetermined path is made in real-time as each of said fields is scanned during said reading.

19. The method as set forth in claim 17 said further comprising:

dithering said sheet of paper during reading of said audio data for maintaining a low signal-to-noise ratio during said reading.

20. The method as set forth in claim 17 implemented in an ink-jet printer.

21. The method as set forth in claim 20 wherein said data reader is mounted on a scanning carriage of said printer.

22. The method as set forth in claim 17 wherein said data reader is a digital camera.

23. The method as set forth in claim 22 wherein said data set is formatted as a two-dimensional array.

24. A method for aligning a linear audio data track for a subsequent track scanning read head adapted for reading the track wherein the track is printed proximate a substantially contemporaneously recorded and printed graphical image, the method comprising:

aligning an approximate mid-height point of the read head wherein the read head has span greater than a height dimension of said track with an approximate centerline of said track;

dithering said read head while traversing a predetermined length of said data track and recording any change in vertical location of top-of-track, bottom-of-track, or both;

calculating track skew from said change; and adjusting path-of-scan said read head for said skew for said subsequent track scanning read head during a subsequent reading of said track.

25. A method for aligning a linear audio data track for a subsequent track scanning, linear array detector adapted for reading the track wherein the track is printed proximate a substantially contemporaneously recorded and printed graphical image, the method comprising:

when the detector has a span less than a height dimension of said track, aligning an approximate mid-height point of said detector to a linear edge of said track, or, when the detector has a span greater than a height dimension of said track, aligning an approximate mid-height point of said detector to a centerline of said track;

detecting changes of output characteristics of said detector while scanning said track related to one or both linear edges thereof, and calculating track skew from said changes of output characteristics.

26. A photographic imaging system comprising:

a digital camera having an audio recording and playback subsystem; and a printer for printing image data and audio data associated with the images recorded using said camera on a sheet medium, wherein said digital audio data is printed on said medium without interfering with visibility of said image data and with alignment indicia data proximate said audio data for maintaining reading alignment thereof and such that said alignment indicia is readable by said digital camera.

27. The system as set forth in claim 26 said camera further comprising:

an illumination source for illuminating alignment indicia data and/or audio data in print that is outside the visible spectrum.

28. The system as set forth in claim 26 wherein said audio data is segmented and printed in a plurality of regions on said sheet medium, said alignment indicia data further comprises:

a plurality of camera-readable section delineation markers such that said alignment indicia data and associated segments of said audio data can be sequentially retrieved from said plurality of regions.

29. The system as set forth in claim 28 wherein said markers are embedded with camera-readable encoded digital information.

30. The system as set forth in claim 29 wherein said camera-readable encoded digital information includes array partitioning information related to location of segregated segments of said audio data.

31. The system as set forth in claim 29 wherein said camera-readable encoded digital information includes sequencing information for playback of said audio data.

32. The system as set forth in claim 29 wherein said camera-readable encoded digital information includes print matrix designating information including information for tracking and identifying audio data recapture order for playback of said audio data by said camera.

33. The system as set forth in claim 32 wherein said matrix designating information provides automatic sequencing of said audio data regardless of capture order.

* * * * *